US005769279A

United States Patent [19]

Smrt

[11] Patent Number: 5,769,279

[45] Date of Patent: Jun. 23, 1998

[54] AEROSOL CONTAINER DISCHARGING APPARATUS WITH FLAG STAKING CAPABILITY

[76] Inventor: Thomas J. Smrt, 10014 S. Grant Hwy., Marengo, Ill. 60152

[21] Appl. No.: 684,398

[22] Filed: Jul. 19, 1996

[51] Int. Cl.[6] ..... B67D 5/64

[52] U.S. Cl. ..... 222/174; 222/191

[58] Field of Search ..... 222/174, 191, 222/192, 175, 611.2; 52/103, 105; 116/211, 173; 239/532; 111/7.4, 33

[56] References Cited

U.S. PATENT DOCUMENTS

| | | |
|---|---|---|
| 3,977,570 | 8/1976 | Smrt . |
| 4,099,482 | 7/1978 | Smrt . |
| 5,368,202 | 11/1994 | Smrt . |
| 5,518,148 | 5/1996 | Smrt . |

OTHER PUBLICATIONS

Dakcor, Inc., Marking Flag Staker With Remote Paint Sprayer, Promotional Sheet, undated.

Dakcor, Inc., Marking Flag Staker, Promotional Sheet, undated.

*Primary Examiner*—Philippe Derakshani

*Attorney, Agent, or Firm*—Leydig, Voit & Mayer, Ltd.

[57] ABSTRACT

An apparatus for discharging the contents of an aerosol container and for creating an opening in a substrate. The apparatus includes a rod member having a front and a rear end; a holder for the aerosol container disposed adjacent the front end of the rod member; an arm which effects movement of the aerosol container actuator between discharging and non-discharging positions; a trigger and linkage system which controls the movement of the actuating arm; and a stake member for creating an opening in a substrate, such as the ground.

15 Claims, 3 Drawing Sheets

AEROSOL CONTAINER DISCHARGING APPARATUS WITH FLAG STAKING CAPABILITY

FIELD OF THE INVENTION

This invention generally relates to devices for discharging the contents of aerosol containers and, more particularly, to an aerosol container discharging device having flag-staking capability.

BACKGROUND OF THE INVENTION

The use of aerosol containers for dispensing marking compositions is well-known, e.g., for striping construction sites, and for marking the location of utility lines. In addition to using aerosol compositions to mark an area, small flags are often used to mark particular locations within the area. For example, in a construction site, an aerosol marking composition may be used to mark the precise location of existing utility lines, with small flags being used to specifically identify the type of utility line being marked, e.g., water, gas, or electric. These flags typically include a metal wire stem or pole and small flag attached thereto that may contain words and/or a depiction of that which is being marked.

A number of devices have been developed which allow a person making marks using aerosol compositions to remain relatively upright, while at the same time positioning the container relatively close to the surface to be marked. These devices further allow the discharge of the aerosol container to be controlled by the user. Examples of these types of devices are provided by U.S. Pat. Nos. 5,368,202 and 5,518,148.

While the foregoing devices solve many of the problems associated with marking surfaces using aerosol containers, they do not solve all of the problems associated with marking areas using aerosol containers in conjunction with flags. In particular, when marking areas with flags, it is necessary for the person placing the flags to carry a device for creating a hole in the ground into which a flag is placed. This is due to the construction of such flags, which typically include a stem or pole that readily bends under pressure. This problem is of particular concern when the ground is frozen or dry. Thus, in order to make both types of marks at a location, a user must simultaneously transport the flags, a spade or shovel to make a hole for the flags, and an aerosol container. Transporting all of this equipment around a construction site can be quite unwieldy and problematic.

Accordingly, a need exists for an apparatus which overcomes the foregoing problems associated with demarcating an area of interest.

SUMMARY OF THE INVENTION

The present invention provides a solution to the foregoing problems by providing an apparatus which allows a user to discharge an aerosol container filled with a marking composition onto a substrate, and create an opening in a substrate. More specifically, the apparatus includes a rod member having a front and a rear end; means for holding the aerosol container disposed adjacent the front end of the rod member; actuating means which effects movement of the aerosol container actuator between discharging and non-discharging positions; means for controlling movement of the actuating means; and means comprising a stake member for creating an opening in a substrate.

These and other features and advantages of the invention will be more readily apparent upon reading the following description of a preferred exemplified embodiment of the invention and upon reference to the accompanying drawings.

While the invention will be described and disclosed in connection with certain preferred embodiments and procedures, it is not intended that the invention be limited to those specific embodiments. Rather it is intended that the present invention cover all such alternative embodiments and modifications as fall within the spirit and scope of the present invention.

DETAILED DESCRIPTION OF THE PREFERRED EMBODIMENTS

In accordance with one preferred embodiment of the present invention, there is provided an aerosol container apparatus with the dual capability of creating an opening in a substrate, e.g. making a hole in the ground to facilitate the placement of a marker flag in the ground, while also allowing a user to control the discharge of an aerosol container held at a remote distance from the user.

Figure 1:
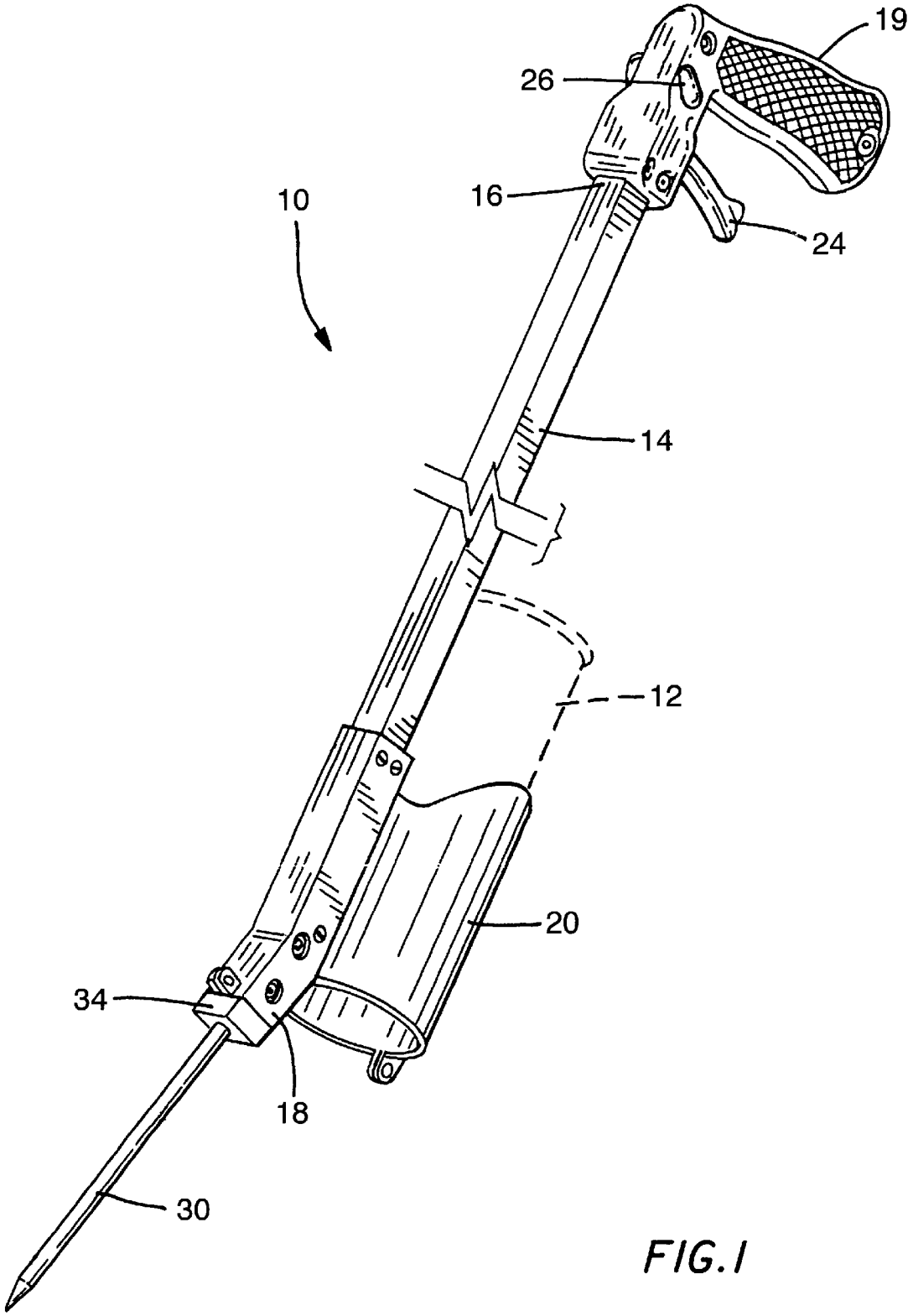
FIG. 1 is a perspective view of an aerosol container discharging apparatus with flag staking capability constructed according to one preferred embodiment of the present invention.
Figure 2:
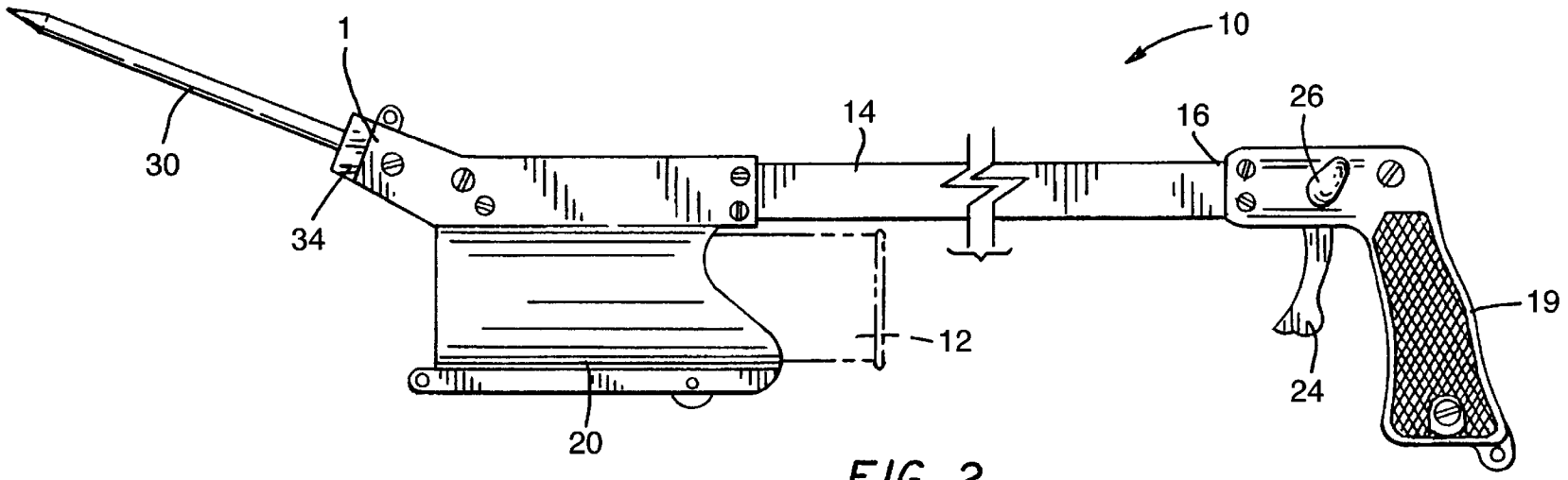
FIG. 2 is a side view of the aerosol container discharging apparatus of FIG. 1.

Turning initially to FIGS. 1–2, there is illustrated a preferred embodiment of the apparatus 10 of the present invention which can be used with conventional aerosol containers 12 (shown in broken lines). The aerosol container 12 includes an actuator (not shown) that moves between discharging and non-discharging positions thereby controlling the discharge of the contents of the aerosol container 12.

The apparatus 10 includes an rod member 14 which serves as the component onto which, or within which, a number of other components of the apparatus are disposed. As shown in this preferred embodiment, the rod member has a length which allows the apparatus to have an overall length of about three feet. This allows a user to remain relatively upright when marking a substrate and making a hole therein, while allowing the discharging end of the aerosol container to be located about one foot from the substrate. Of course, the rod member 14 can be of varying lengths, e.g., from a few inches (e.g., FIGS. 9–11 of U.S. Pat. No. 5,368,202) to several feet, and of any cross-sectional shape (e.g., circle, square) without adversely affecting the performance and other advantages of the present invention.

Most advantageously, the rod member is hollow and has a square cross-section. This allows the various components to reside within the apparatus, protected from disabling bumps, while still enabling a manufacturer to readily vary the length on the rod member to suit the desired application.

A handle grip 19 for manual grasping by the user of the discharging apparatus 10 is disposed at the rear end 16 of the rod member 14. Means for receiving and holding the aerosol container 12 is disposed adjacent the front end 18 of the rod member 14. In the illustrated embodiment, the container holding means comprises a generally cylindrical structure 20 which is sized to receive the aerosol container 12. Within the container holder 20 is an annular flange (not shown) that is adapted to engage a ridge portion on the aerosol container 12 thereby properly positioning and retaining the aerosol container 12 within the cylindrical structure 20.

The apparatus 10 also includes actuating means which affects movement of the aerosol container actuator between the discharging and non-discharging positions. In a preferred embodiment, the actuating means comprises an actuator push rod 23 (shown in FIG. 6) that is mounted on or within the rod member 14 and is movable relative to the aerosol container in the aerosol container holding means. In this way, the actuating means can be moved between a discharging position, wherein the actuator rod effects movement of the aerosol container actuator into the discharging position, and a non-discharging position wherein the actuator is not moved into the discharging position.

Generally, discharge of the container contents is affected by moving the actuator from its normal, non-discharging, position into a discharging position, wherein the spring-biased container valve 25 (shown in FIG. 6) is opened. Various types of actuators and biased valves may be used, and are well known in the art. Exemplary of such combinations are valves that are opened when the actuator is moved laterally with respect to the longitudinal axis of the container, and those that are opened when the actuator is moved toward the container. The actuating means should be designed to accommodate one or both types of aerosol container valve and actuator combinations.

Figure 6:
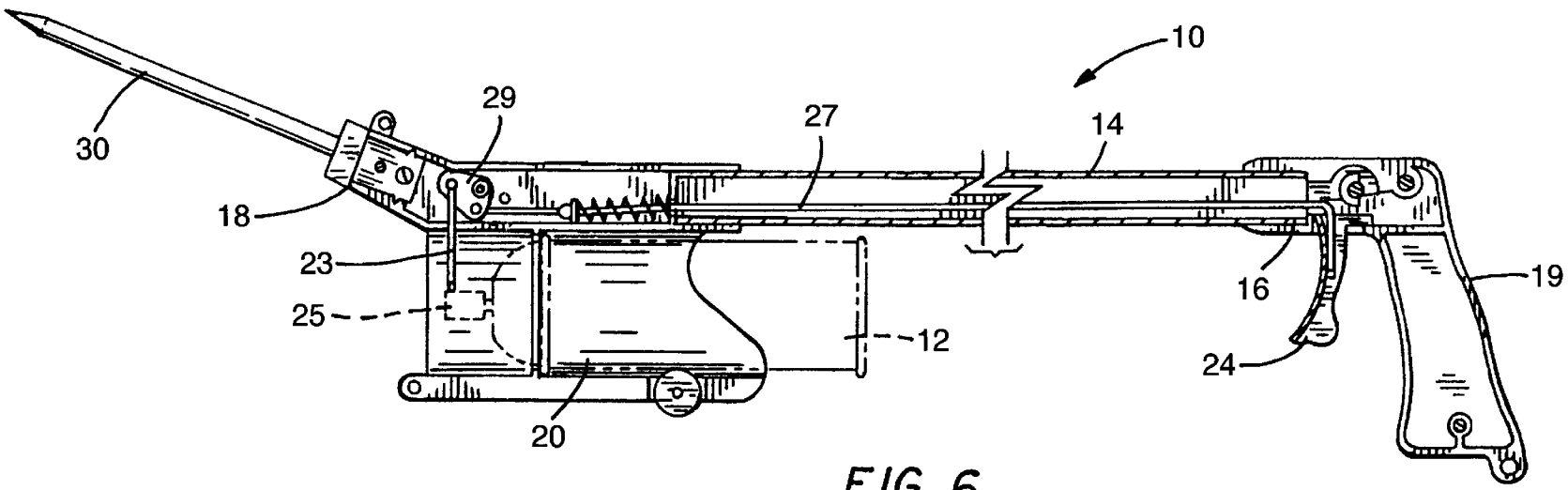
FIG. 6 is a side longitudinal sectional view of the aerosol container discharging apparatus of FIG. 1.

The apparatus 10 also includes means for controlling the movement of the actuating means, and thereby the aerosol container actuator, between the discharging and non-discharging positions. In the illustrated embodiment, the control means comprises a triggering mechanism which includes a trigger 24 that is disposed adjacent the rear end 16 of the rod member 14 near the handle grip 19. The trigger 24 is attached to and controls the movement of a trigger rod 27 disposed on, or most preferably within, the hollow rod member 14 as shown in FIG 6. The movement of the trigger rod is translated into lateral movement of the actuator rod by a bell crank 29 disposed near the front end of the housing 14. Optimally, the illustrated embodiment may also include an optional lock switch 26 which, if utilized can be used to place the trigger 24, and thereby the triggering mechanism, into a continuously discharging position. The use of such an arrangement is disclosed in U.S. Pat. No. 5,368,202.

While the means and components which allow a user to control the discharge of an aerosol container held at a remote distance from the user have been described in connection with certain preferred embodiments, those skilled in the art will appreciate that the present invention is equally applicable to other aerosol container discharging devices.

Figure 3:
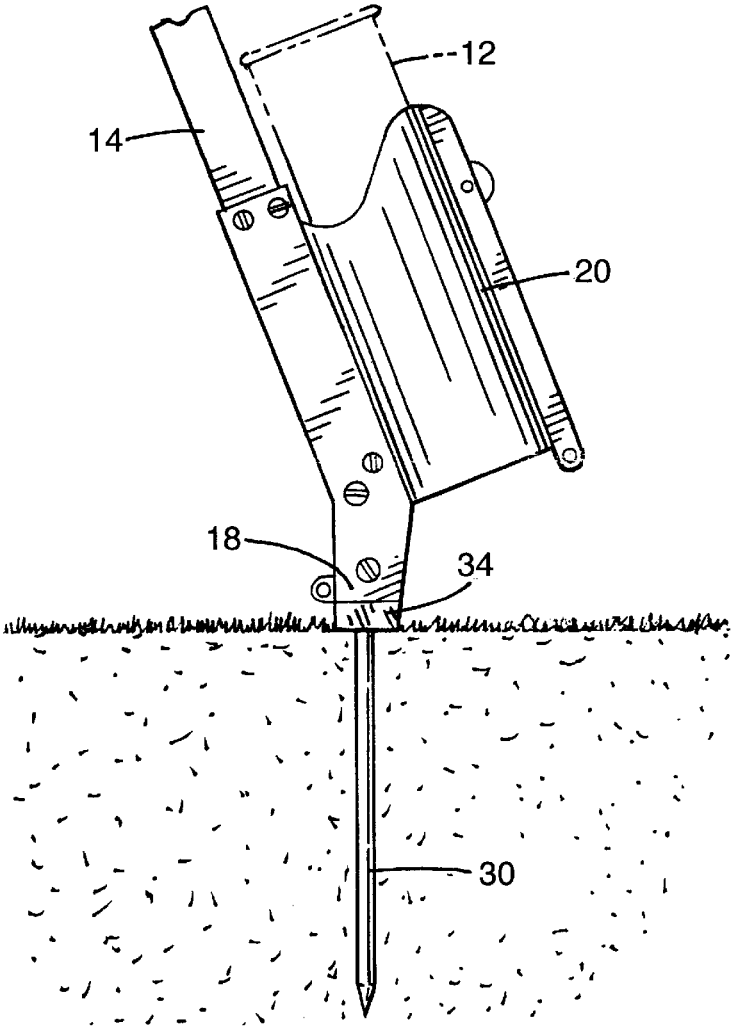
FIG. 3 is a partial side view of the aerosol container discharging apparatus of FIG. 1 showing how the apparatus can be used to create an opening in a substrate, in this case a hole in the ground.

In accordance with an important aspect of the present invention, the apparatus 10 includes means comprising a stake member for creating an opening in a substrate. As set forth in FIGS. 1–3, there is illustrated a first embodiment of the discharging apparatus 10, wherein an embodiment of the stake member 30 is depicted. As shown in FIGS. 1–3, the stake member 30 is disposed on the front end 18 of the rod member 14, within a cavity formed by the aerosol container holding means 20. The stake member will advantageously taper along its length, and preferably terminates in a point at its distal end, such providing for ease of insertion of the stake member into the substrate.

As will be appreciated by those skilled in the art, there are a number of different types of stake members that can provide an opening in the ground suitable for the insertion of a flag marker, and a number of ways the stake member can be mounted onto the dispensing apparatus. It is not intended that the invention be limited to either the particular type of stake member, or the specific mounting method, depicted in the figures and described herein. For example, and alternatively, the stake member may comprise a plastic molded part which tapers to a point and has a generally x-shaped cross-section, and the stake member may be attached onto the rod member directly.

The stake member is preferably oriented in the position depicted, wherein the stake member projects generally perpendicularly away from the front end 18 of the rod member 14. This arrangement of the stake member 30 relative to the rod member 14 prevents the stake member 30 from interfering with any marking that may occur, while retaining the ability of the stake member to be easily manipulated by the user.

When the user of the apparatus 10 wishes to create an opening in the surface being marked, e.g., in the ground allowing insertion of a marker flag, the user need only manipulate the discharging apparatus 10 so that the stake member 30 is substantially perpendicular relative to the surface being marked. Once the stake member 30 is near the perpendicular position, it can be inserted into the surface, as shown in FIG. 3, thereby creating a hole for the marker flag. The flag may then be manually inserted into the hold.

Figure 4:
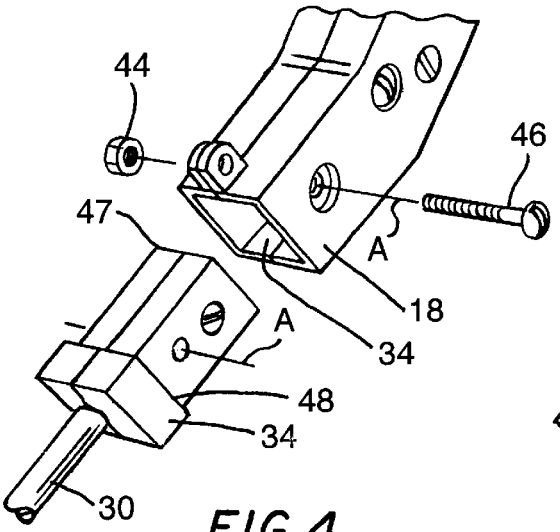
FIG. 4 is an enlarged partially exploded view of the aerosol container discharging apparatus of FIG. 1 showing a means for mounting the stake member mounting bracket to one end of the rod member.
Figure 5:
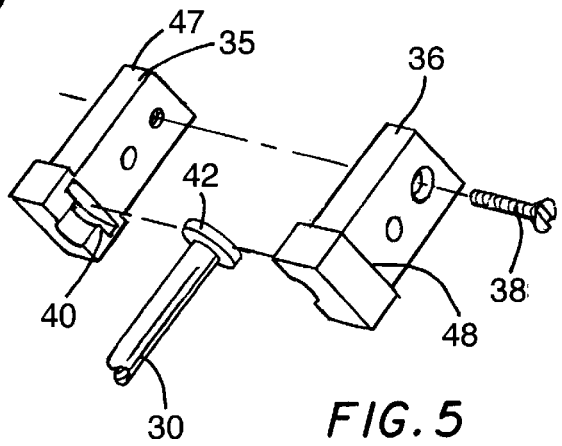
FIG. 5 is an enlarged partially exploded view of the stake member mounting bracket and stake member of FIG. 4.

The stake member 30 may also be adapted so that it can be easily attached to presently existing aerosol discharging devices in order to retrofit them for flag-staking capability. In particular, and as shown in the embodiment of FIGS. 1–5, the stake member 30 includes a mounting bracket 34 which facilitates the connection of the stake member 30 to the container holder 20. As shown in FIG. 5, the mounting bracket 34 preferably comprises two mirror image portions 35, 36 which are joined together by any suitable fastening means, such as, for example, the illustrated screw 38 or a rivet. The mounting bracket also includes a cavity 40 within which a flange portion 42 which is located on one end of the stake member 30 can be positioned. Thus, as shown in FIG. 5, in order to attach the stake member 30 to the mounting bracket 32, the mirror image portions 35, 36 need only be separated, the flange portion 42 inserted into the cavity 40, and the mirror image portions 35, 36 reassembled together via the fastening means, such as a screw 38. once the stake member 30 has been attached to the mounting bracket 34, the mounting bracket 34, in turn, can be attached to the front end face 32 of the rod member 14. As shown in FIG. 4, in order to facilitate this connection, the free end 47 of the mounting bracket has a smaller cross sectional area than the front end 18 of the rod member 14. Thus, the free end 47 of the mounting bracket 34 can be easily inserted into the front end face 32 of the container holder 20. While careful attention to dimensions can provide a mounting bracket that is held in place on the front end of the rod member by friction alone, such may be secured in place by use of any suitable attachment means, such as, e.g., the illustrated nut 44 and bolt 46. In order to ensure that free end 47 of the mounting bracket 34 is properly inserted, the end of the bracket which receives the stake member 30 is slightly larger than the free end 47 such that an collar 48 is created between the two ends of the bracket. This collar 48 engages the front end face 32 of the holder 20 when the free end 47 of the bracket is fully inserted into the holder 20.

Those skilled in the art will appreciate that, while the illustrated mounting bracket provides a simple means for attaching the stake member to the discharging apparatus, other types of mounting brackets and means also could be used to attach the stake member to the discharging apparatus. The stake member even could be formed integrally with the rod member or aerosol container holder of the discharging apparatus. In addition, it will be appreciated that other orientations of the stake member relative to the rod member could be used, including projecting the stake member angularly away from the front end of the housing and attaching the stake member at some point adjacent the front end other than at the end face of the front end.

All of the references cited herein, including patents, patent applications, and publications, are hereby incorporated in their entireties by reference.

While the present invention has been described with an emphasis upon preferred embodiments, it will be obvious to those of ordinary skill in the art that variations of the preferred embodiments disclosed herein may be used and that it is intended that the invention may be practiced otherwise than as specifically described herein. Accordingly, this invention includes all modifications encompassed within the spirit and the scope of the invention as defined by the following claims.

What is claimed is:

1. An apparatus for discharging the contents of an aerosol container and for creating an opening in a substrate, the aerosol container having an actuator which can be moved between discharging and non-discharging positions, the apparatus comprising:

a rod member having a front and a rear end;

means for holding the aerosol container disposed adjacent the front end of the rod member so that the contents of the aerosol container will be discharged directly onto the substrate;

actuating means which effects movement of the aerosol container actuator between discharging and non-discharging positions;

means for controlling movement of the actuating means; and means comprising a stake member disposed adjacent the front end of the rod member for creating an opening in a substrate.

2. The apparatus of claim 1, wherein the stake member has a first and second end, and wherein a flange is provided on the first end.

3. The apparatus of claim 2, wherein the stake member is comprised of a metal and has a generally cylindrical cross-section which tapers to a point at the second end thereof.

4. The apparatus of claim 1, wherein the stake member is a nail.

5. The apparatus of claim 1 wherein the stake member is attached to the rod member.

6. The apparatus of claim 1 wherein the stake member is attached the means for holding the aerosol container.

7. The apparatus of claim 1 wherein the stake member is integral with the rod member.

8. The apparatus of claim 1 wherein the stake member is integral with the means for holding the aerosol container.

9. An apparatus for discharging the contents of an aerosol container and for creating an opening in a substrate, the aerosol container having an actuator which can be moved between discharging and non-discharging positions, the apparatus comprising:

a rod member having a front and a rear end;

means for holding the aerosol container disposed adjacent the front end of the rod member, actuating means which effects movement of the aerosol container actuator between discharging and non-discharging positions;

means for controlling movement of the actuating means;

means comprising a stake member for creating an opening in a substrate, the stake member having first and second ends;

a flange on the first end of the stake member; and a mounting bracket attached to the aerosol container holding means, wherein at least the flange of the stake member is retained within a cavity in the mounting bracket.

10. The apparatus of claim 9, wherein the mounting bracket comprises at least two pieces which are joined together by a fastening means.

11. The apparatus of claim 10, wherein the stake member is comprised of a metal and has a generally cylindrical cross-section, and wherein the second end of the stake member tapers to a point.

12. The apparatus of claim 11, wherein the stake member is a nail.

13. An apparatus for discharging the contents of an aerosol container and for creating an opening in a substrate, the aerosol container having an actuator which can be moved between discharging and non-discharging positions, the apparatus comprising:

a rod member having a front and a rear end;

means for holding the aerosol container disposed adjacent the front end of the rod member;

actuating means which effects movement of the aerosol container actuator between discharging and non-discharging positions;

means for controlling movement of the actuating means;

means comprising a stake member for creating an opening in a substrate, the stake member having first and second ends;

a flange on the first end of the stake member; and a mounting bracket disposed adjacent the front end of the rod member, wherein at least the flange stake member is retained within a cavity of a mounting bracket.

14. The apparatus of claim 13 wherein the mounting bracket is attached to the rod member.

15. The apparatus of claim 14 wherein the mounting bracket is attached to the means for holding the aerosol container.

* * * * *